United States Patent [19]

Hager

[11] Patent Number: 4,702,543

[45] Date of Patent: Oct. 27, 1987

[54] ENVIRONMENTAL SEAL AND ALIGNMENT MEANS FOR AN ELECTROMAGNETICALLY FORMED BACKSHELL

[75] Inventor: Jeffrey J. Hager, Port Hueneme, Calif.

[73] Assignee: G & H Technology, Inc., Santa Monica, Calif.

[21] Appl. No.: 857,255

[22] Filed: Apr. 30, 1986

[51] Int. Cl.[4] ..... H01R 13/504

[52] U.S. Cl. ..... 439/271; 29/421 M; 439/607

[58] Field of Search ..... 339/143 R, 94 R, 94 A, 339/94 C, 94 M; 29/421 M

[56] References Cited

U.S. PATENT DOCUMENTS 4,349,241 9/1982 Juris et al. ..... 339/143 R
4,531,798 7/1985 Baur et al. ..... 339/94 M
4,579,415 4/1986 Van Brunt et al. ..... 339/143 R

FOREIGN PATENT DOCUMENTS 1314138 11/1962 France ..... 339/94 M

*Primary Examiner*—John McQuade
*Attorney, Agent, or Firm*—George J. Netter

[57] ABSTRACT

A cylindrical rubber or elastomeric gasket which is L-shaped in cross-section having an outwardly extending rim or flange is initially located between a cylindrical backshell and a connector part which the backshell is to be magnetically clamped. The internal diameter of the seal closely approximates the major diameter of the connector part. The backshell end is slid onto the connector part and, more particularly, onto and over the seal with the seal flange extending around the end of the backshell with its outermost surface abutting against a flange on the connector part. The seal in this way accomplishes both aligning of the backshell with the axis of the connector part for the electromagnetic forming step and, as well, effects environmental sealing after the backshell is fully in place.

4 Claims, 6 Drawing Figures

ENVIRONMENTAL SEAL AND ALIGNMENT MEANS FOR AN ELECTROMAGNETICALLY FORMED BACKSHELL

The present invention relates generally to a plug and receptacle electrical connector, and, more particularly, to an environmental seal and alignment means for a backshell which is electromagnetically formed onto a connector part.

BACKGROUND OF THE INVENTION

The connector with which the present invention has its most advantageous utilization consists of plug and receptacle parts which can be releasably joined to one another to effect electrical connection between cable wires through internal pin and socket contacts. An ever increasing requirement is that the connector and its wires leading thereto be protected against pollution by external electromagnetic fields. The cable end of the connector parts are readily accessible to such external fields and special means are used in order to eliminate, to the extent possible, ingress of these fields into the cable end of the connector part. A well accepted manner of doing this is to use a backshell consisting of a metal tube interconnected to the connector part by clamping thereon through the use of an electromagnetic forming technique sometimes referred to as "magneforming" which effectively seals off even minute openings or spaces between the backshell and the connector part thereby protecting the enclosed electrical parts from external ambient fields.

U.S. Pat. No. 4,579,415, Cable Shield Grounding Apparatus by M. K. Van Brunt and J. J. Hager discloses such a clamping of a tubular backshell onto a connector part by the use of an electromagnetic forming technique. It is additionally a requirement of this patent application that the backshell and connector part be protected against dust, dirt and moisture from the environment and the technique described therein and which is frequently employed at the present time, is to provide an O-ring located within a groove in the outside peripheral surface of the connector part which is compressed when the backshell is clamped thereon to effect environmental sealing.

There are many situations in which the physical size of a given connector part where the O-ring must be located is of restricted thickness and, therefore, cannot accommodate the required depth for an O-ring groove. Also, for most efficient production of an electromagnetically formed tubular metal backshell onto a mandrel, such as a connector part, it is important that the backshell and mandrel be held in alignment during magnetic forming. In the past, alignment has been accomplished by special holding fixtures and alignment tooling. The fixtures and tooling can be relatively complex and expensive when quality forming and repeatability are required.

SUMMARY OF THE DISCLOSURE

A primary object and aim of the present invention is the provision of an environmental seal for use between a connector part which are electromagnetically clamped together, which seal is also used to align the backshell and connector part during fabrication.

The metal backshell which is to be connected to a connector part is substantially cylindrical in form with an imperforate side wall, one end of which is affixed in a conventional manner to the grounding shield, for example, of a cable and the other end of which is to be electromagnetically clamped onto the end of a cylindrical connector. Electromagnetic forming of the backshell causes the backshell wall to be formed into intimate contact with ridges and grooves on the peripheral surface on the connector part.

The environmental seal consists of a generally cylindrical rubber or elastomeric gasket which is L-shaped in cross-section having an outwardly extending rim or flange. The internal diameter of the seal closely approximates the major diameter of the connector part onto which the backshell is to be located. Initially, the seal is placed upon the connector part and the backshell end slid onto the connector part and, more particularly, onto and over the seal with the seal flange extending around the end of the backshell with its outermost surface abutting against a flange on the connector part. The seal in this way accomplishes both aligning of the backshell with the axis of the connector part for the electromagnetic forming step and, as well, effects environmental sealing after the backshell is fully in place.

DESCRIPTION OF THE PREFERRED EMBODIMENT

Figure 1:
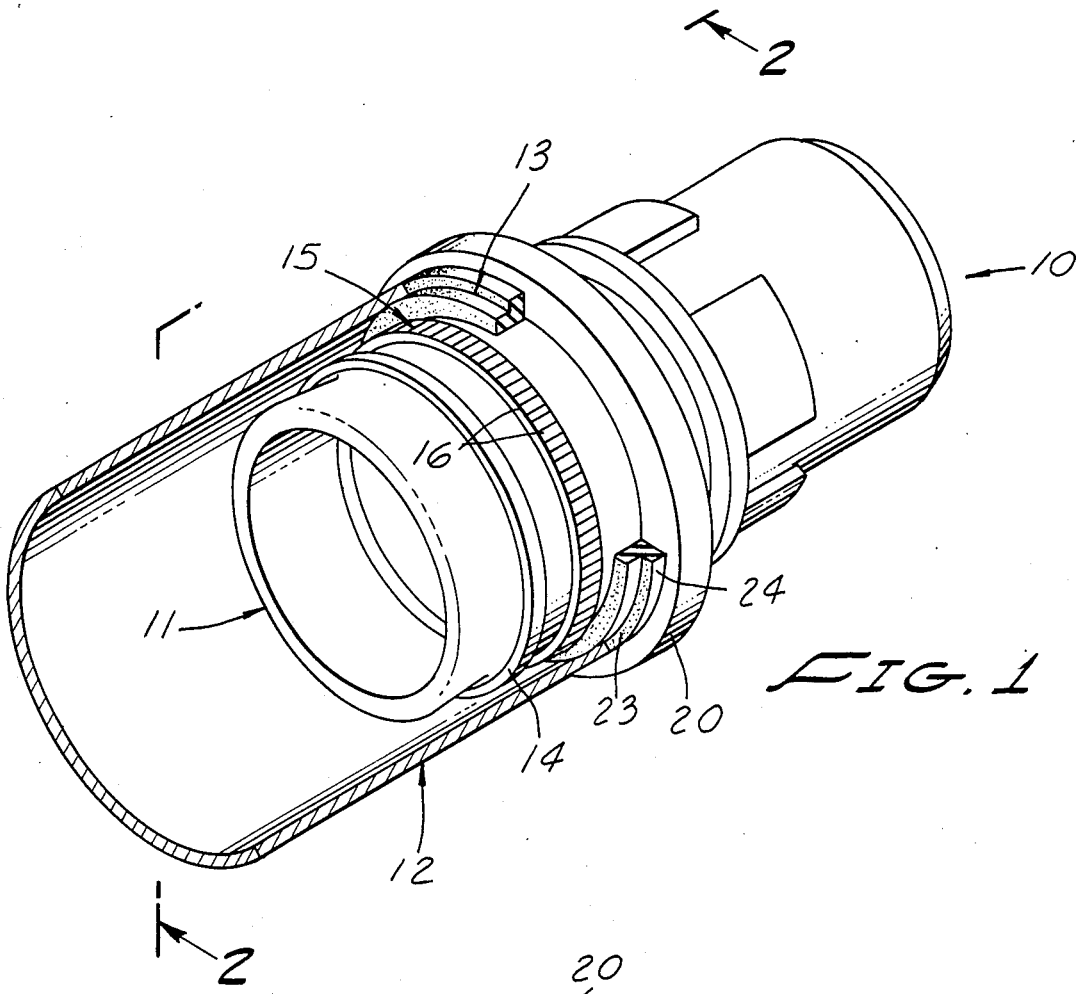
FIG. 1 depicts a perspective view of a connector part with backshell and environmental sealing gasket of this invention shown in place.
Figure 2:
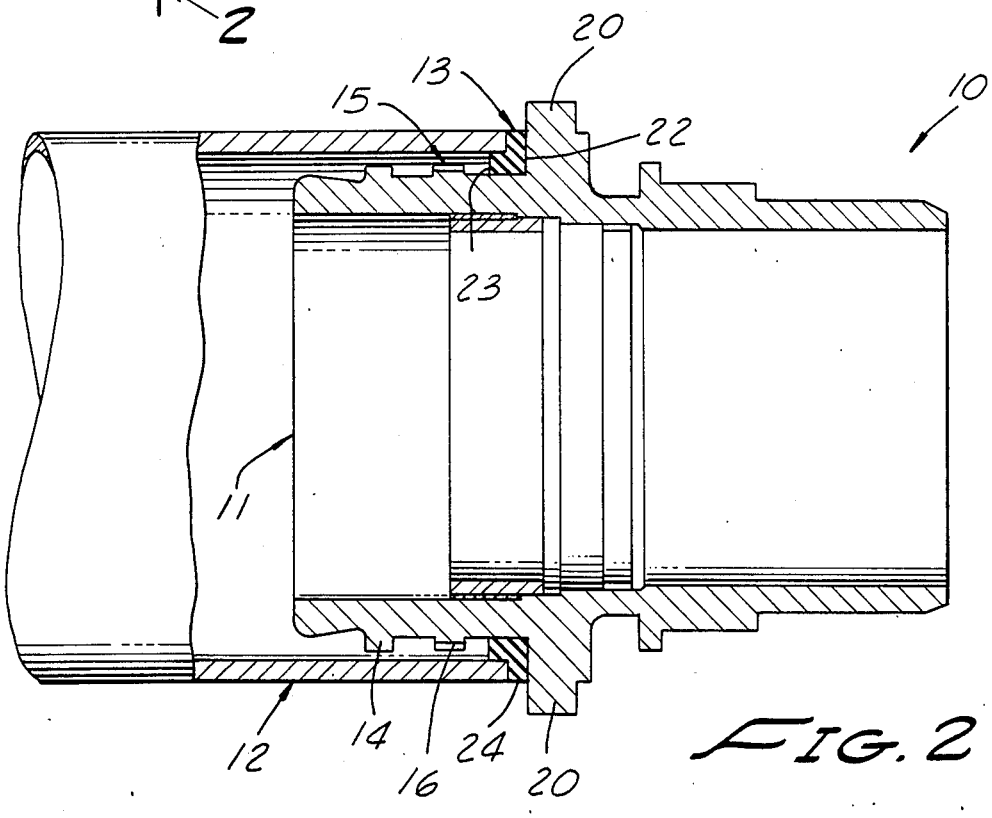
FIG. 2 is a side elevational sectional view taken along the line 2—2 of the FIG. 1 showing the backshell and environmental seal in place prior to electromagnetic forming of the backshell.

Turning now to the drawings, and particularly FIG. 2, a connector part 10 with which the present invention is advantageously employed, consists generally of a hollow metal tubular member 11 including insulating inserts within which respective contacts (e.g., pin or socket contacts) are received connected to a respective plurality of cable wires. In a known way, a complementary pair of connector parts (i.e., plug and receptacle) can be releasably connected together for mating their respective contacts, and, in that way, cable wires of the two connector parts are electrically interconnected. It is to be understood that the present invention applies to either of the connector parts, a plug and a receptacle, and since the principles in construction are the same, only the application of the invention to what is termed a receptacle connector part will be described in detail.

A backshell 12 consists of a deformable tubular metal cylinder that is received about incoming cable wires to the receptacle (not shown) and has one end conductively secured about an end portion of the receptacle connector part in a way to be described in order to prevent unwanted electromagnetic fields from gaining access to the enclosed cables and electrical contacts of the connector part. The opposite end of the backshell is also conductively secured onto a cable shield (not shown). More particularly, an environmental sealing gasket 13, to be described in greater detail later, is located between the backshell end portion and opposed surfaces of the receptacle shell as well as an upstanding radially, outwardly extending flange on the connector part to serve both as an alignment means during electromagnetic forming of the backshell to the connector and as an environmental seal for the completed connector and backshell assembly.

Figure 3:
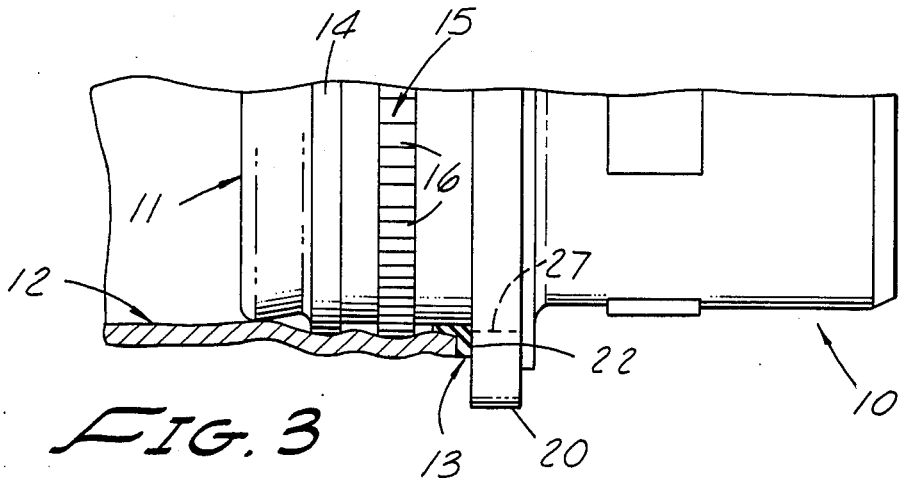
FIG. 3 is a sectional, elevational view similar to FIG. 2 and showing the backshell clampingly formed into place onto the connector part.

Turning now to FIG. 2, the receptacle tubular shell 11 is seen to have an end portion including a first circumferentially extending ridge or flange 14 and axially spaced therefrom a second circumferentially extending ridge or flange 15 having its outermost surface formed into a set of teeth 16 as shown in FIG. 3. In general as to electromagnetic forming of the backshell, the backshell 12 is placed over the flanges 14 and 15 and an electromagnet field applied thereto which deforms the backshell to intimately follow the contours of the flanges and the intervening peripheral surface of the receptacle shell so as to provide both mechanical strength to the connection as well as close off all openings between the backshell and connector part via which external electromagnetic fields could otherwise gain access.

Figure 5:
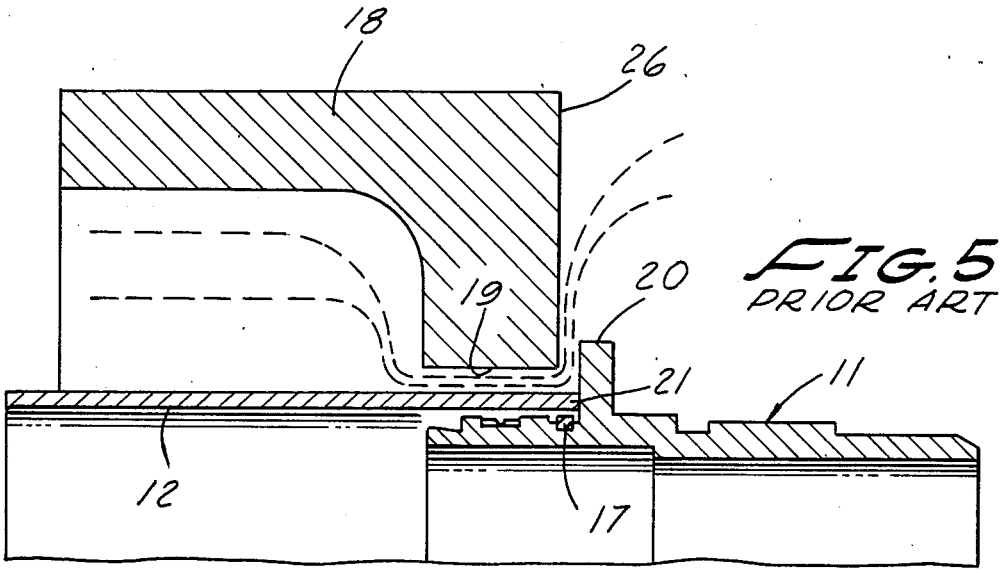
FIG. 5 PRIOR ART
FIG. 5 shows electromagnetic forming equipment in place on a backshell in which the prior art O-ring technique is used to effect environmental sealing.

As shown in FIG. 5, the conventional technique for effecting electromagnetic forming of a backshell to a connector part consists first of locating an O-ring 17 within a groove formed in the peripheral surface of the connector part. Following this, the backshell is then aligned and received onto the connector part end such that the backshell inner surface is equally spaced from the outer surface of the connector part throughout its complete circumference. Then, a so-called field concentrator 18 having an oversize cylindrical bore 19 is received over the backshell and maintained with the bore walls equally spaced from the backshell outer surface and thereby in alignment with both the backshell and underlying connector part. To accomplish this necessary alignment and spacing relationship fixtures were provided in the past to properly locate the backshell with respect to the connector part 11 as well as the field concentrator 18.

It is also important for effective electromagnetic forming that the field concentrator not be allowed to come into direct contact with any of the parts, such as the backshell 12 or the receptacle flange 20, for example. When the field concentrator is precisely located in this manner, then a high pulse of electromagnetic energy is applied via the field concentrator onto the backshell causing it to conform very closely to the outer surface of the connector part in those regions directly opposite the field concentrator surfaces.

Figure 4:
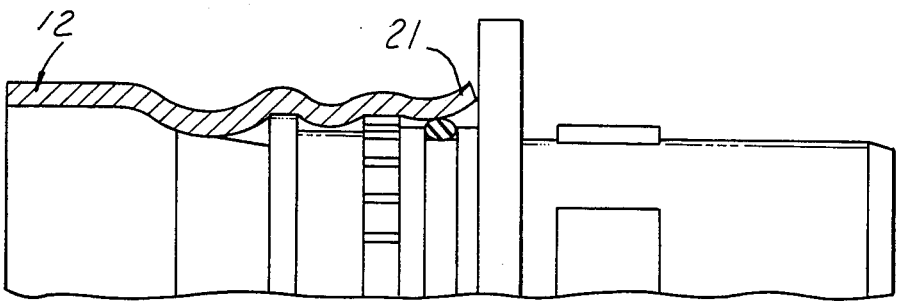
FIG. 4 PRIOR ART
FIG. 4 is a sectional elevational view showing a prior art environmental seal of the O-ring variety.

Any portion of the backshell which extends beyond the field concentrator application surface, such as the end portion 21, will not be directly acted upon by the electromagnetic forming field, and as shown in Figure 4, the electromagnetic forming will cause this end portion 21 to extend upwardly slightly as a result of the adjacent backshell regions being crimped or clamped inwardly. Moreover, if the backshell outer end initially contacts the flange, it will tend to dig into the flange during forming of the adjacent backshell portions frequently preventing a good clamping relationship about the O-ring 17 which will have deleterious results on sealing (FIG. 4).

Still further, for proper mechanical and field excluding affixation of the backshell to the connector, it has been found beneficial to apply an axial preload to the backshell forcing the backshell and connector part together prior to electromagnetic forming. This preload, in the case of the prior art example just given, reduces the efficiency of magnetic forming in that the preload causes a digging in of the backshell end wall into flange 20 during forming which substantially reduces the radial clamping force on the O-ring 17.

Figure 6:
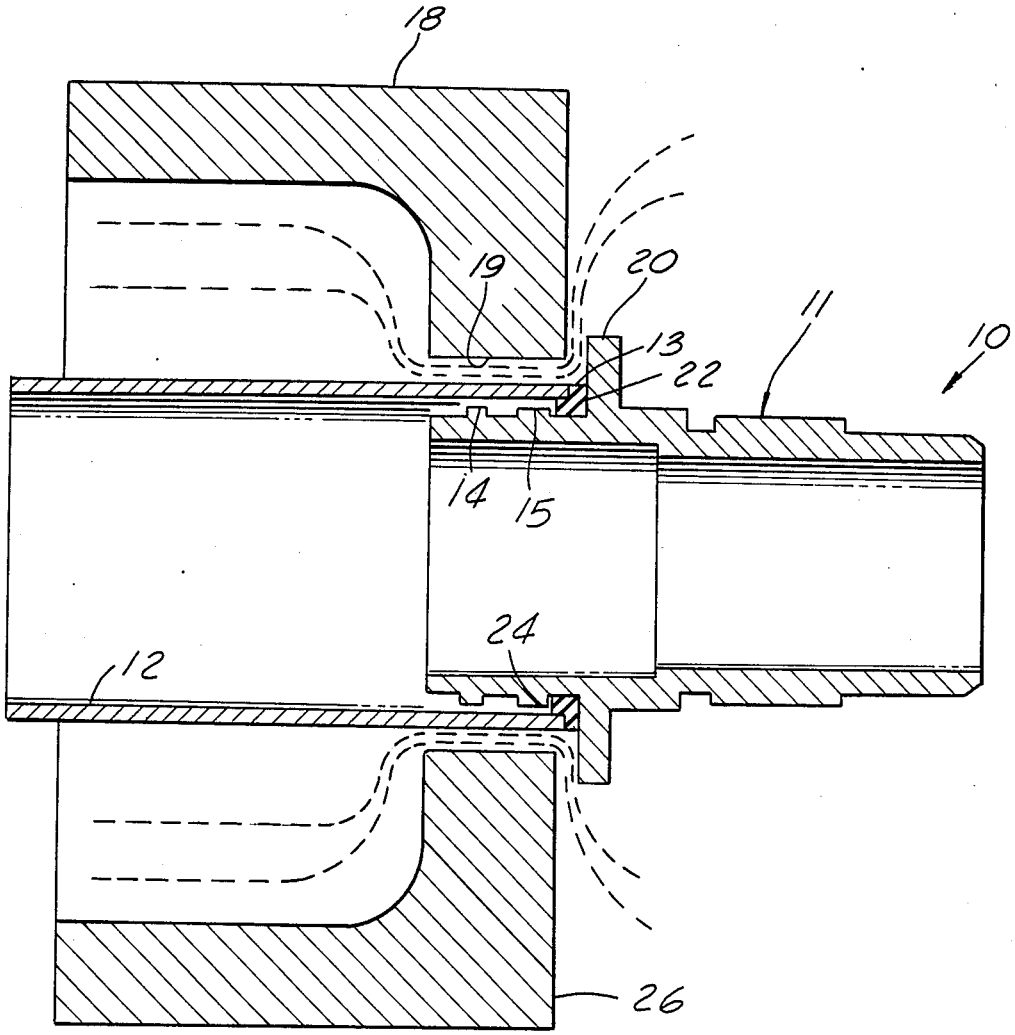
FIG. 6 is a side elevational, sectional view of a connector part with backshell aligned thereon by the environmental seal of this invention.

All of the various problems discussed herein above that have previously been encountered in the utilization of electromagnetic backshell forming onto a connector part are eliminated by the use of the special environmental sealing gasket 13 which also serves as an alignment fixture during backshell forming. Specifically, the gasket 13 is a generally annular member made of rubber or an elastomeric material having an internal bore enabling tight fitting receipt of the sealing gasket onto the connector part at a point closely adjacent to the receptacle flange 20. One lateral face 22 of the gasket is flat and smooth so as to enable intimate abutting and sealing arrangement against the flange 20. The side 23 opposite face 22 is formed into a circumferentially extending shoulder 24 of such dimensions as to enable fitting receipt of the unformed backshell end therein as shown in FIGS. 2 and 6, for example. The shoulder 24 and flat lateral face 22 provides the seal with a generally L-shaped cross-section. Moreover, the thickness of the gasket is uniform throughout its entire circumference in order to position the backshell at a constant spacing to the receptacle shell outer surface.

It is important that the sealing gasket be constructed of a material that is sufficiently flexible to enable experiencing the necessary distention to pass the gasket initially over the flanges 14 and 15 and yet when positioned against the mounting flange 20, it will clamp closely about the outer surface of the connector part with the face 22 pressing against the flange.

In assembly of the backshell to the connector part, first the gasket 13 is placed on the open end of the receptacle shell 11 over the flanges 14 and 15 with the lateral face 22 smoothly abutting against mounting flange 20 (FIG. 6). The backshell 12 is then slipped onto the receptacle shell and fitted into the gasket shoulder 24 and an axial force is applied to the backshell pressing it against the gasket and preloading the receptacle and backshell with respect to each other via the gasket resilience. Then, the field concentrator 18 is located about the backshell with its magnetic force application jaws 19 being located directly opposite the receptacle backshell end part to be connected to the connector, and equally spaced therefrom. It is important to note that when properly arranged the outermost face 26 of the field concentrator lies in the same plane as the end of the backshell which insures working of the backshell full end portion and reducing in that way dissipation of the magnetic field. Finally, a sufficiently large pulse of magnetic energy is applied via the field concentrator which effects forming of the backshell to the condition shown in FIG. 3. More particularly, the gasket is now compressed radially as a result of the magnetic forming and the backshell closely adapts to the external surface configuration of the receptacle shell. Moreover, due to preloading, the environmental sealing gasket will, in addition to maintaining the integrity of the interior against access to external foreign matter, also aid sealing against electromagnetic field by maintaining a constant axial force tending to push the receptacle flanges and backshell into contact with one another.

In the practice of the described invention a generally L-shaped gasket is provided which initially serves to properly position a backshell with respect to a connector part during magnetic forming of the backshell onto the connector. After the backshell is formed into place, the same gasket now acts as an environmental seal preventing dust, dirt and moisture from gaining access to the connector part interior at the backshell juncture. By utilizing the L-shaped gasket as a positioning spacer, the backshell can be located farther within the magnetic forming field while maintaining the necessary distance between the field concentrator 18 and the connector part flange 20.

Still further, there are certain connectors where there is no shoulder or flange against which the backshell can be located during magnetic forming. This is indicated in FIG. 3 by the dash line 27 through the flange 20 indicating the general peripheral connector shell peripheral surface with the flange removed. The L-shaped gasket, in this case, provides a surface against which the backshell end may bear to establish desired pre-load.

I claim:

1. An article of manufacture comprising:

a hollow cylindrical metal tube;

a cylindrical member of outer diameter less than the tube inner diameter, said member having end portions received within an end of the tube and uniformly spaced from facing tube inner wall surfaces, said member further having a radially outwardly extending flange lying directly opposite and spaced from the member end portions;

an annular resilient seal of generally L-shaped cross-section located between both the tube inner wall surfaces and member end portions and between and in contact with the tube end and the member flange;

said metal tube being magnetically clamped onto the member end portions over the seal compressing the same.

2. A method of electromagnetically deforming a metal shell into clamping engagement with a cylindrical member having an end portion received within an open end of said shell, said member having an outwardly directed flange on its peripheral surface spaced inwardly from the member end portion, comprising the steps of:

locating a resilient non-metallic annular seal about the cylindrical member end portion and abutting against the flange, said seal having a first diametral portion which closely approximates the inner cross-sectional dimensions of the shell and a second diametral portion larger than the first diametral portion, said second diametral portion extending between the shell end and the flange;

positioning the shell on the first diametral portion of the seal;

aligning an annular magnetic field concentrator on the shell directly opposite the cylindrical member end portion; and energizing the magnetic field concentrator to clampingly deform the shell and compress the seal causing it to expand against the cylindrical member end portion and flange.

3. A method as in claim 2, in which the magnetic field concentrator is positioned to direct a magnetic field on the shell end.

4. A method as in claim 3, in which the energizing includes pulsing.

* * * * *